United States Patent [19]

Morin

[11] 4,401,300

[45] Aug. 30, 1983

[54] AIR BEARING SHELF

[75] Inventor: George A. Morin, Aurora, Colo.

[73] Assignee: Leger' Equipment Corp., Aurora, Colo.

[21] Appl. No.: 332,739

[22] Filed: Dec. 21, 1981

[51] Int. Cl.[3] ..... B65H 5/30

[52] U.S. Cl. ..... 270/55; 270/57; 271/195; 198/644

[58] Field of Search ..... 270/54–57; 198/644; 271/195; 53/266 A, 381–382, 492, 568

[56] References Cited

U.S. PATENT DOCUMENTS

| | | | |
|---|---|---|---|
| 3,556,515 | 1/1971 | Mueller | 271/195 X |
| 3,561,751 | 2/1971 | Dutro | 270/55 |
| 4,275,873 | 6/1981 | Rathert | 270/54 |

FOREIGN PATENT DOCUMENTS

| | | | |
|---|---|---|---|
| 9287 | of 1927 | Australia | 270/55 |

*Primary Examiner*—A. J. Heinz

*Attorney, Agent, or Firm*—Fields, Lewis, Pittenger & Rost

[57] ABSTRACT

An air bearing shelf is provided for supporting a newspaper jacket in open position while being transported on a conveyor during addition of an insert into the jacket at printing press speed. The jacket is oriented on the conveyor with the jacket spine aligned with the direction of conveyor movement. The open side of the jacket is split by a sword, and the top portion of the jacket is elevated by sliding on a transition piece until the free side of the top portion enters a pathway bounded on opposite sides by air cushions supplied through apertured upper and lower walls at the margins of the pathway, while the bottom portion of the jacket continues along the plane of the conveyor and is surpressed below an air cushion supplied through the apertured wall over the pathway of the bottom portion. An insert is delivered into the open jacket via a slot located between the upper and lower jacket portion pathways, and the slot is provided with air cushions at its top and bottom margins to center the insert during passage through the slot. The various apertures supplying air cushions are in communication with one or more pressure vessles and are oriented to direct pressurized air along a vector that is partially angled in the direction of conveyor movement so that drag on the jacket is reduced and the jacket and insert are urged to move with the conveyor.

14 Claims, 4 Drawing Figures

AIR BEARING SHELF

DESCRIPTION

1. Technical Field

The invention relates to sheet-material associating and in particular to insetting signature gatherers. The invention further relates to sheet feeding and delivering and particularly to delivering by pneumatic conveyor using pressurized gas.

2. Background Art

Newspaper publishers often place supplements or inserts in the newspapers, typically as a service to advertisers wishing to reach the newspaper's readership. One difficulty with the use of inserts is that the devices that automatically place the inserts into the newspaper jacket are unable to operate with a speed equal to high speed printing presses. As a result, the use of inserts is limited to those instances in which a supplement is prepared in advance of the publication date and the inserts can be placed in the supplement over a period of days.

In a typical newspaper stuffing operation, the newspaper jackets are conveyed lengthwise, with the jacket spine aligned with the direction of motion. A splitter or sword is positioned in the path of travel and at the open side of the jackets so that each jacket is conveyed past the sword and is partially opened by receipt of the sword between two of the jacket leaves. Continued conveyor movement carries the jacket past the sword and causes the upper leaf to slide over a transition area and onto a shelf, which supports the leaf in open position while the lower leaf is moved under the shelf. An insert may be placed between the upper and lower leaves as the jacket travels past the shelf. At the end of the shelf, the upper leaf is guided to a lowered position at which the jacket is closed.

The problem with such a typical stuffing operation is that newspaper jackets cannot be handled at a sufficiently high speed in the described apparatus. The leaves forming the jacket are quite pliable and tend to deform from flat condition when moved at high speed. One cause of deformation is air resistance. Because the jackets are moved with the spine aligned with the direction of movement, the ends of the leaves are facing the direction of movement. The leaves are thus prone to flutter and fan when moved at sufficiently high speeds. Another cause of deformation is friction between the leaves and the surfaces over which the leaves are caused to slide. The upper leaves rest upon a stationary shelf that carries a substantial portion of the weight of the split portion of the jacket. The lower, open side of the jacket typically extends over the side of the conveyor and rests on a fixed platen, which bears at least part of the jacket weight prior to splitting and bears part of the weight of the lower leaves during movement through the shelf area. Frictional drag and page flutter thus prevent the stuffing operation from proceeding at as fast a rate as inserts might otherwise be supplied to the jackets.

The present invention seeks to provide improved high speed handling of jackets in stuffing operations and the like, as will be fully explained below.

DISCLOSURE OF INVENTION

In accordance with this invention, apparatus and method are provided for the transport of a pliable jacket having at least first and second leaves in open position. According to the apparatus of the invention, which is intended for use in combination with a conveyor means adapted to move the jacket in a longitudinal direction of conveyor movement, a first jacket leaf transport mechanism includes opposed first and second means for delivering a fluid cushion and defining therebetween a first gap oriented generally parallel to the longitudinal direction of conveyor movement. The first and second such means are oriented to deliver pressurized into the first gap from opposite sides of the gap for, in use, permitting movement of the first leaf through the first gap between suspending fluid cushions formed by the pressurized air. A second jacket leaf transport mechanism includes a third means for delivering pressurized air and defining at least one margin of a second gap longitudinally juxtaposed to the first gap and generally parallel to the longitudinal direction of conveyor movement. The third means is oriented to deliver pressurized air into the second gap for, in use, permitting movement of the second leaf through the second gap in the longitudinal direction with a fluid cushion formed by the pressurized air on at least one side thereof. The first and second gaps are offset from each other at an acute angle with respect to the conveyor means, as viewed in transverse cross-section to the longitudinal direction of conveyor movement for, in use, maintaining the first and second jacket leaves in open position while passing through the gaps.

The first and second jacket leaf transport mechanisms may define a slot extending longitudinally between them for receiving and permitting passage of an insert being placed between the open leaves of the jacket. A fourth means delivers pressurized air into the slot from one boundary of the slot for, in use, providing a fluid cushion between the insert passing through the slot and the slot boundary. Further, a fifth means for delivering pressurized air into the slot may be substantially opposed to the fourth means for, in use, permitting movement of the insert through the slot between the opposed fluid cushions formed by the pressurized air.

Any of the means delivering fluid pressurized air may be defined by a pressure vessel wall having a fluid transmission aperture communicating with the gap or slot to which pressurized air is being delivered. The apertures are preferred to be angled acutely in the direction of longitudinal conveyor movement so that the fluid cushion formed by the pressurized air urges the jacket leaf or insert being contacted by the fluid cushion to move in the direction of conveyor movement.

The first transport mechanism may include both an upper shelf segment and a lower shelf segment defining the upper and lower sides of the first gap, respectively. The upper and lower segments may be joined by a connecting wall and thereby define a U-shaped boundary along the first gap. Both segments may be a portion of a common pressure vessel delivering pressurized air into the gap from a single source. The lower wall of the lower shelf segment may supply pressurized air into the top side of the slot, also from the common pressure source. Further, a hold-down segment spaced below the lower shelf segment may supply pressurized air via its top wall to the lower side of the slot and may supply pressurized air via its bottom wall to the upper side of the second gap. The hold-down segment may also receive its pressurized air from a common source with the upper and lower shelf segments.

Pressurized air delivered to opposite margins of the slot serves to center an insert that may be delivered through the slot for placement in the open jacket. Such an insert is delivered from a conveyor moving transversely to the jacket conveyor and receiving a supply of inserts for continuous sequential delivery through the slot.

The method of the invention employs a conveyor that is capable of moving a jacket along a longitudinal pathway with the jacket spine substantially parallel to the direction of travel. The jacket is opened by raising the first leaf along the free side of the jacket opposite from the spine. The free side is then suspended between opposed air cushions formed by pressurized air and defining a first longitudinal pathway parallel to and elevated above the longitudinal pathway of the jacket conveyor. The second leaf of the jacket is surpressed under an air cushion formed by pressurized air defining one side of a second longitudinal pathway extending parallel to the jacket conveyor. A stationary surface may support the opposite side of the second leaf.

As the jacket is so conveyed in open position with the open side of the jacket facing transversely, an insert may be placed in the open jacket by conveying the insert toward the open side of the jacket along a second conveyor pathway that intersects the jacket conveyor pathway vertically between the first and second longitudinally pathways of the leaf free sides. The insert is directed through a slot between such pathways, where the insert is centered in the slot by upper and lower opposed air cushions formed by pressurized air. After the insert has passed into the open jacket, the first and second longitudinal pathways for the leaf free sides may be terminated, permitting the upper leaf to close upon the lower leaf and the insert by force of gravity.

DESCRIPTION OF PREFERRED EMBODIMENTS

Figure 1:
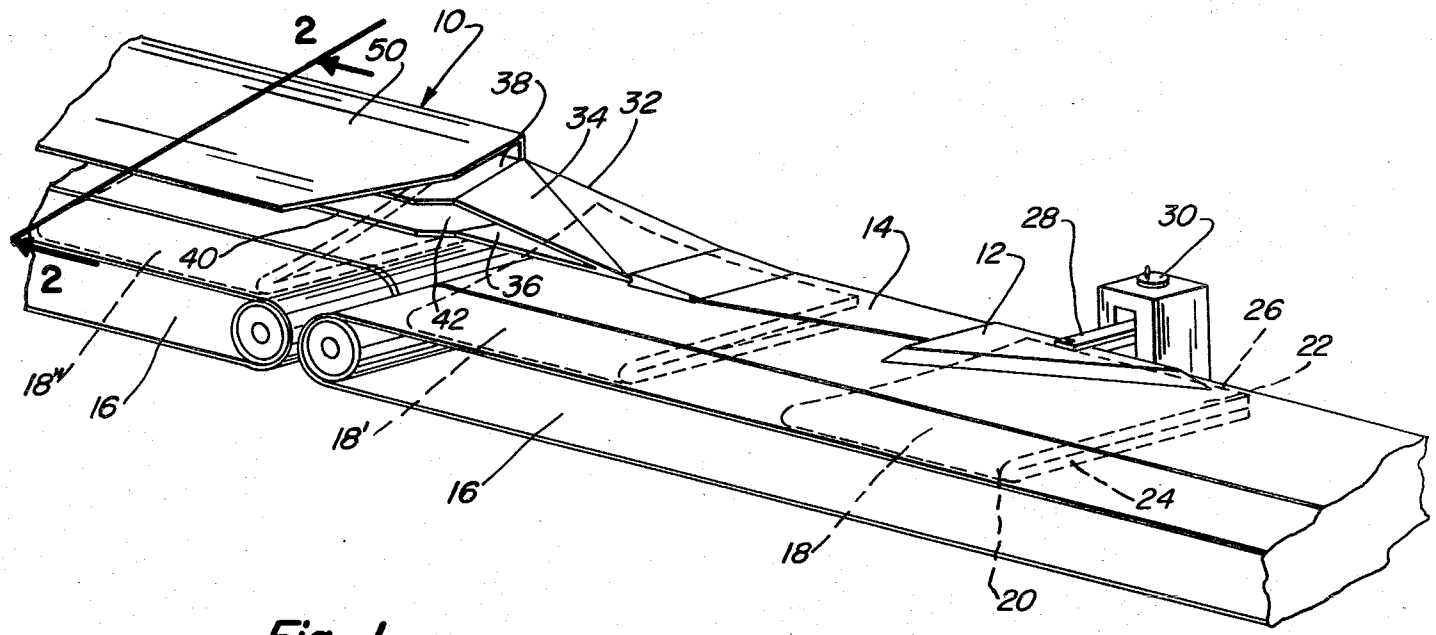
FIG. 1 is an isometric view of the air bearing shelf with the associated splitter and transition area, and showing the jackets in phantom being moved on a jacket conveyor.

As shown in the drawings, the invention relates to an apparatus for the transport of a pliable jacket. Such an apparatus is embodied in air bearing shelf 10 of FIG. 1, shown in operative combination with a splitter means such as sword 12 and transition piece 14. A jacket conveyor means such as one or more belt conveyors 16 establish a generally longitudinal pathway parallel to the air bearing shelf, sword, and transition piece; and the conveyors 16 carry the pliable jackets such as newspaper jackets 18, shown in phantom, in a predetermined positional orientation permitting the jackets to be acted upon by the sword and air bearing shelf.

The pliable jackets 18 consist of at least one body of sheet material folded upon itself so as to define a spine 20 at the fold line, with the sheet portion on one side of the fold line being conveniently referred to as the first jacket leaf or upper leaf 22 and the sheet portion on the second side of the fold line being referred to as the second jacket leaf or lower leaf 24. Each of leaves 22 and 24 are defined to have a free edge 26 opposite from the spine 20, signifying that the jacket may be opened by separation of the edges 26. When sheet portions 22 and 24 are in substantially parallel, overlapping position, the jacket may be referred to as being in closed position; while when the sheet portions are in an acutely angled relative position to each other, such that a crevice or wedge-shaped cavity is formed between the first and second leaves, the jacket is defined to be in open position. The significance of open position is that an insert may be placed between the first and second leaves from the free-edge side of the jacket without substantial interference from the free edges. Often, the jacket will consist of many folded pages, and these pages may be folded upon themselves, either individually or in sandwiched stacks, on as many as two perpendicular axes. Such complex jackets define the spine along the final or outermost fold, such that any number of leaves or folded sheets are contained between the outer leaves of the jacket; and the jacket may be in open position when split at its free edges at any proportionate division between the two outer leaves of the jacket.

Jackets 18 are arranged on a horizontal belt conveyor 16 with the jacket spine 20 substantially parallel to the direction of longitudinal conveyor movement. Initially in closed position, the jackets are transported in a continuous stream past the splitter means, where sword 12 is positioned at an appropriate height above the conveyor belt to pass between two leaves of the jacket. The sword may be supported from a height adjustable mechanism such as lateral arm 28 carried on a vertical threaded shaft for rotation, whereby the height of the sword is selected according to the desired thickness of the split. A crank wheel 30, for example, may provide a suitable means to rotate the threaded shaft and adjust the relative position of the sword. The transition piece 14 is connected to the downstream end of the sword and receives the top portion or first leaf of the jacket on top of the transition piece. The primary purpose of the transition piece is to provide a coupling between the sword and the air bearing shelf while permitting the sword to be height-adjusted. After the sword has established the initial split plane in the jacket, the transition piece maintains the split as the conveyor continuously moves the jacket downstream toward the air bearing shelf. Jacket 18' of FIG. 1 is shown passing over the transition piece and initially encountering the air bearing shelf.

The entry portion 32 of the air bearing shelf receives the jacket from the transition piece 14 and applies positive jacket opening forces through divergent guide plates 34 and 36. The former plate is joined at its downstream end to the bottom shelf segment 38, which receives the first leaf or split portion of the jacket above it; while the latter plate is connected to a hold-down segment 40, which receives the second leaf or bottom portion of the jacket below it. The divergent guide plates 34 and 36 define the initial portion of a slot 42 between them, which slot is continued between the bottom shelf segment 38 and the hold-down segment 40, providing an access opening for placement of an insert into the open jacket, as will be subsequently described.

Figure 2:
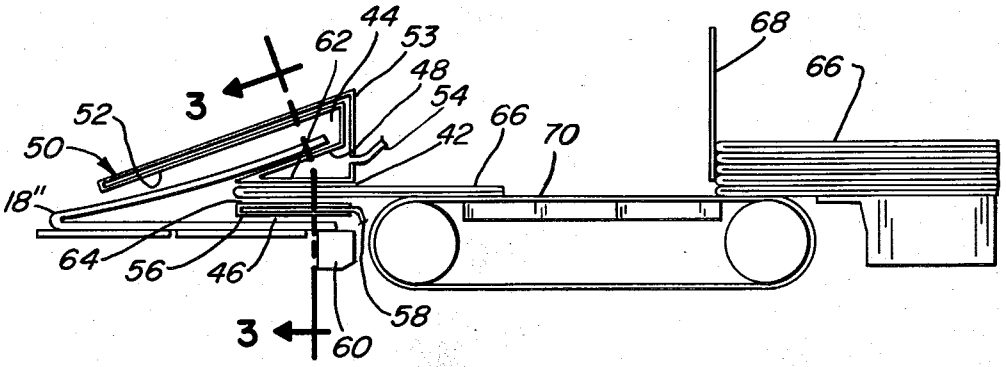
FIG. 2 is a cross-sectional view taken along the plane of line 2—2 of FIG. 1, showing the insert supply and insert conveyor.

With reference now to FIGS. 1 and 2, the jacket 18'' is entirely downstream of the transition piece and the entry portion of the air bearing shelf, and the first leaf 22 is maintained by the shelf in open position with respect to the second leaf 24. The free edges of both first and second leaves are, respectively, in first and second gaps 44 and 46 extending parallel to the longitudinal direction of conveyor travel and offset from each other with the first gap above the plane of the jacket conveyor when viewed in transverse cross-section, as in FIG. 2. The first and second leaves are thus held open at an acute angle. The first gap 44 is defined by a pair of opposed means for delivering pressurized air into the gap from opposite sides thereof to form a fluid cushion. One such means may include the bottom shelf segment 38, which defines a pressure vessel having wall 48 underlying the first leaf free edge. A second such means may include a top shelf segment 50 defining a pressure vessel having wall 52 extending over the first leaf free edge. As shown in FIG. 2, the top and bottom shelf segments may form a single pressure vessel connected by end wall 53 and receiving a supply of pressurized fluid from a single source 54. Pressure vessel walls 48 and 52 deliver the pressurized fluid via suitable apertures communicating with the first gap 44. The fluid so delivered, which preferably is air, defines a fluid cushion at the face of each wall 48 and 52 in the first gap and thereby suspends the first leaf between the fluid cushions as it moves longitudinally through the gap with the conveyor 16.

Second gap 46 is defined on at least one side, such as the top side was viewed in FIG. 2, by a third means for delivering pressurized air to at least one margin of the gap. Such third means may include the hold-down segment 40, which defines a pressure vessel having a wall 56 overlying the second leaf free edge. Wall 56 is suitably apertured to deliver pressurized fluid into the second gap and to thereby create a fluid cushion on the lower surface of the wall and to maintain such a cushion between the wall and the second leaf. Pressurized fluid is delivered to the hold-down segment from a source 58, which may be a common source with source 54. The side of the second gap opposite from the hold-down segment may be defined by a platen 60 and a portion of the conveyor belt 16, both of which support the second leaf free edge against the air cushion supplied through the hold-down segment. The second gap is approximately co-planar with the horizontal plane of the jacket conveyor.

The top and bottom shelf segments 38 and 50 together define an efficient transport mechanism for supporting the first jacket leaf during longitudinal movement along the conveyor pathway. The hold-down segment, in combination with an opposed support surface, defines a further transport mechanism for the efficient support of the second jacket leaf during longitudinal movement along the conveyor pathway. The first and second gaps 44 and 46, respectively, defined by the two transport mechanisms are longitudinally juxtaposed with each other and with the longitudinal conveyor pathway to simultaneously support the jacket leaf free edges for at least a portion of the air bearing shelf length. The pressurized air delivered into the first and second gaps maintain the pliable leaves in relatively undistorted alignment with the direction of longitudinal travel with the conveyor and thereby permit the rapid transport of the jacket, while in open position, along the jacket conveyor pathway.

Slot 42 is juxtaposed to the first and second gaps through the longitudinal portion of the air bearing shelf wherein the latter two gaps are mutually juxtaposed. A fourth means for delivering a pressurized air into the slot provides one margin of the slot. For example, lower shelf segment 38 may have a bottom pressure vessel wall 62 having suitable apertures for delivering pressurized air from the lower shelf segment into the slot 42 from the upper side of the slot. A fifth means for delivering pressurized air may define the margin of the slot opposite from the fourth means. The upper wall 64 of the hold-down segment may serve in this capacity, with suitable apertures in the upper wall delivering pressurized air from the hold-down segment into the slot.

Figure 4:
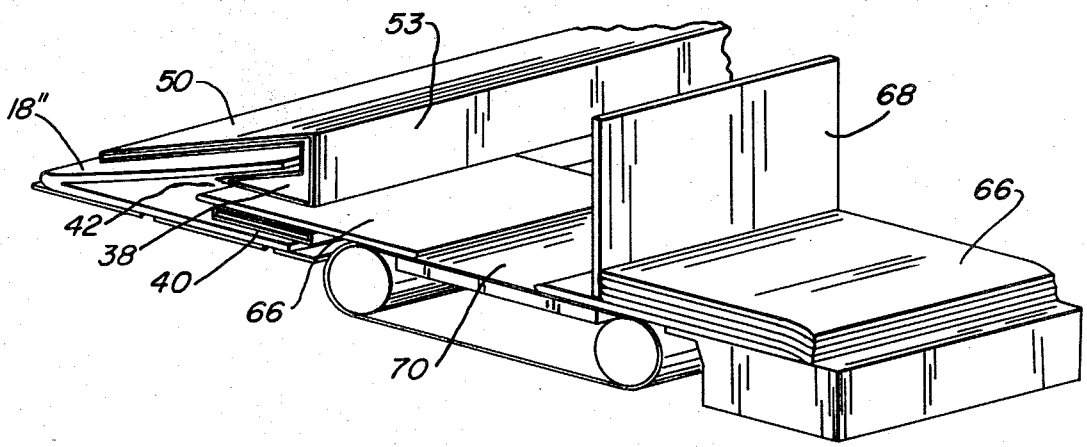
FIG. 4 is an isometric view of the air bearing shelf and inserting apparatus, similar to FIG. 2.

In FIGS. 2 and 4, the function of slot 42 is shown during the placement of an insert 66 into the open jacket 18″. A supply of inserts 66 is provided in stacked array that is maintained behind a gate 68. The lower end of the gate is maintained at a preselected spacing above an insert conveyor means such as belt conveyor 70, which is positioned to move an insert along a pathway that is transverse with respect to the longitudinal pathway of jacket conveyor 16. The inserts are dispatched singly under gate 68 and are moved by insert conveyor 70 in vertical alignment with slot 42 along a pathway that intersects the jacket conveyor. The conveyor 70 delivers each insert into the slot, where the opposite air cushions from walls 62 and 64 center the insert in the slot and guide the insert through the slot without substantial contact with the slot walls. In this manner, the insert is placed in the open jacket 18″. To assure that each insert is received in a jacket, a timing system may be employed to control the release of inserts from the supply stack in coordination with the progression of jackets on conveyor 16.

Figure 3:
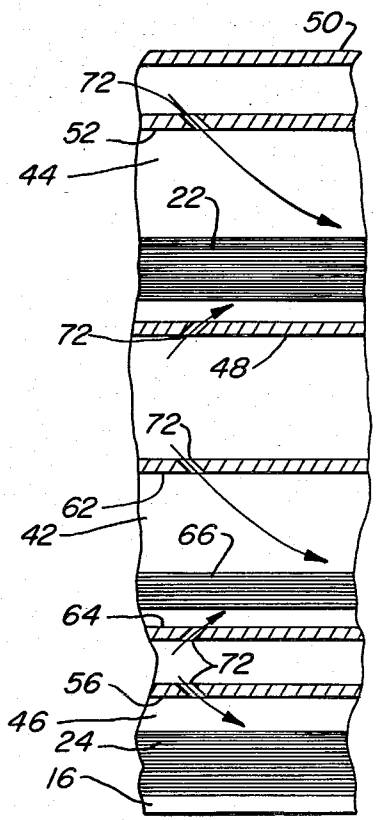
FIG. 3 is an enlarged fragmentary cross-sectional view taken along the plane of line 3—3 of FIG. 2, showing details of the aperture structure.

The air cushions created between the gap walls and the jacket leaves provide the dual advantages of, first, providing low-friction guides for holding the jacket in open position, and second, providing a low-friction means of preventing flutter during the longitudinal movement of the jacket with the conveyor 16. Both functions are enhanced by biasing the direction of air flow from the pressure vessels toward the longitudinal direction of conveyor movement. In FIG. 3, the apertures 72 in walls 48, 52, 56, 62 and 64 are shown to be oriented at an angle in the direction of longitudinal conveyor movement. The pressurized air therefore enters gaps 44 and 46 with an angular component urging the jacket leaves to move in the direction of longitudinal conveyor movement. The insert passing through slot 42 is also urged to begin movement in the direction of jacket flow.

The operation of the air bearing shelf is to provide two elongated pathways extending substantially parallel to the longitudinal direction of movement of an associated jacket conveyor, with one of the pathways being offset above the plane of the jacket conveyor. A pliable jacket 18, which may be a newspaper, is conveyed on the jacket conveyor with the jacket spine substantially parallel to the longitudinal direction of travel, and the free edges of the jacket leaves face a lateral side of the conveyor. The jacket is opened by raising the free edge 26 of the first or top leaf on a splitter such as sword 12. Thereafter, the free edge of the first leaf is suspended between air cushions formed by pressurized air within the first pathway for transport through the pathway with the movement of the conveyor. Simultaneously, the free edge of the second leaf is surpressed under an air cushion formed by pressurized air within the second pathway for transport through the pathway with the movement of the jacket conveyor. The lower side of the second pathway may be defined by a solid support surface, such as a platen 60 or the belt of the conveyor. In this manner, the jacket is transported in open position at high speed without significant flutter at the leading edge of the jacket leaves.

An insert may be placed in the open jacket being transported in the above manner by conveying the insert along an insert conveyor pathway that intersects the longitudinal pathway of the jacket conveyor between the first and second pathways and at the open side of the jacket. The insert is guided between the first and second pathways by a pair of opposed air cushions formed by pressurized air bordering opposite margins of the slot 42. Thereafter, the insert is conveyed with the jacket along the jacket conveyor pathway. At the termination of the air bearing shelf, the first leaf exits the first pathway and closes upon the insert by force of gravity. The air cushions provided in the first and second pathways may be vectored in the direction of main conveyor movement in order to minimize drag. Additionally, the air cushions provided in the slot may be vectored similarly in the direction of the main conveyor movement in order to introduce or increase a degree of insert movement in the direction of jacket movement.

The air bearing shelf therefore provides a means for both the rapid transport of a pliable jacket while in open position and for the high speed placement of inserts into such an open jacket. The invention has been described in detail with particular reference to the preferred embodiments, but it is to be understood that variations and modifications can be effected within the spirit and scope of the invention.

I claim:

1. An apparatus for the transport of a pliable jacket having at least first and second leaves in open position, for use in combination with a generally horizontal jacket conveyor adapted to move the jacket in a longitudinal direction above a generally horizontal plane of conveyor movement, said apparatus comprising:

a first jacket leaf transport mechanism including opposed first and second means for delivering pressurized air to form a fluid cushion and defining therebetween a first gap oriented generally above and extending along the plane of jacket conveyor movement, said first and second means being oriented to deliver the pressurized air into the first gap from opposite sides thereof for, in use, permitting movement of the first leaf through the first gap between suspending fluid cushions formed by the pressurized air;

a second jacket leaf transport mechanism, between said first jacket leaf transport mechanism and the plane of conveyor movement, including a third means for delivering pressurized air and defining at least one margin of a second gap longitudinally juxtaposed to said first gap and generally parallel to the longitudinal direction of conveyor movement, the third means being oriented to deliver pressurized air into the second gap for, in use, permitting movement of the second leaf through the second gap in the longitudinal direction with a fluid cushion on at least one side thereof formed by the pressurized air; and wherein the first and second gaps are offset from each other at an acute angle with respect to the longitudinal direction of conveyor movement, for, in use, maintaining the first and second jacket leaves in open position while passing through the gaps.

2. The transport apparatus of claim 1, wherein said first and second jacket leaf transport mechanisms define therebetween a slot generally parallel to the plane of conveyor movement and having a fourth means delivering pressurized air into the slot from a boundary thereof for, in use, providing a fluid cushion between an insert passing through the slot and the slot boundary.

3. The transport apparatus of claim 2, further comprising a fifth means delivering pressurized air into the slot in substantial opposition to the pressurized air of the fourth means for, in use, permitting movement of an insert through the slot between fluid cushions formed by the pressurized air of said fourth and fifth means.

4. The transport apparatus of claim 1, wherein at least one of said first and second means comprises a pressure vessel wall defining a fluid transmission aperture communicating with the first gap and angled acutely in the direction of longitudinal conveyor movement for, in use, directing fluid into the gaps at an angle, urging the first leaf to move in the direction of conveyor movement.

5. The transport apparatus of claim 1 wherein said first and second means each comprises a pressure vessel wall at substantially opposite margins of the first gap, each wall defining a fluid transmission aperture communicating with the first gap and angled acutely in the direction of longitudinal conveyor movement for, in use, directing fluid into the gap at an angle urging the first leaf to move in the direction of conveyor movement.

6. The transport apparatus of claim 1, wherein said third means comprises a pressure vessel wall defining a fluid transmission aperture communicating with the second gap and angled acutely in the direction of longitudinal conveyor movement for, in use, directing fluid into the gap at an angle urging the second leaf to move in the direction of conveyor movement.

7. An apparatus for the transport of a pliable jacket having an open side along a generally horizontal longitudinal path and for the insertion of an insert into the jacket between first and second leaves thereof, comprising:

a generally horizontal jacket conveyor means for, in use, moving the pliable jacket along the longitudinal path with the open side of the jacket facing transversely to the direction of conveyor means movement;

splitter means positioned above said conveyor means for, in use, separating the open side of the jacket between the first and second leaves;

an air bearing shelf having a top shelf segment positioned above said splitter means to receive the open side of the first jacket leaf therebelow, a bottom shelf segment positioned between said top shelf segment and said splitter means to receive the open side of the first jacket leaf thereabove, and a hold-down segment positioned between said splitter means and conveyor to receive the open side of the second jacket leaf therebelow, wherein the hold-down segment and bottom shelf segment define a slot between their respective upper and lower surfaces for at least a portion of the shelf length;

means supplying pressurized air to said air bearing shelf for, in use, creating an air cushion on the lower side of the top shelf segment, on the upper side of the bottom shelf segment, and on the lower side of the hold-down segment; and an insert conveyor means for moving an insert transversely to the jacket means path and delivering the insert through said slot for insertion at the open side of the jacket between the first and second lines.

8. The apparatus of claim 7, wherein said top shelf segment and bottom shelf segment each comprise an apertured surface connected to a pressure vessel and adapted to deliver pressurized air through the apertures, the apertures being oriented at an angle in the direction of jacket conveyor means movement for, in use, urging the first jacket leaf in the direction of jacket movement with said jacket conveyor means.

9. The apparatus of claim 7, wherein said bottom shelf segment and hold-down segment each comprise an apertured surface oppositely bordering said slot and connected to a pressure vessel for delivering pressurized air from opposite sides of said slot for, in use, suspending an insert passing through said slot between air cushions.

10. The apparatus of claim 7, further comprising a platen substantially adjacent to said jacket conveyor means and positioned to support the second leaf along the open side thereof and in opposition to the air cushion of said hold-down segment.

11. The method of transporting in open position a pliable jacket having at least first and second leaves joined at a common spine and having free leaf sides opposite from the spine, comprising:

conveying the jacket along a longitudinal, generally horizontal jacket pathway with the spine substantially parallel to the direction of travel;

opening the jacket by raising the first leaf along the free leaf side opposite from the spine;

suspending said raised free leaf side between opposed air cushions formed by pressurized air and defining a longitudinal first leaf side pathway elevated above and generally following the longitudinal jacket pathway; and suppressing the free second leaf side under pressurized air forming an air cushion defining one side of a longitudinal second leaf side pathway generally following the longitudinal jacket pathway and substantially coplanar therewith.

12. The method of claim 11, further comprising:

supporting the free second leaf side by an underlying stationary surface defining a second side of said longitudinal second leaf side pathway.

13. The method of placing an insert between first and second leaves of a pliable jacket having an open side, comprising:

conveying the jacket along a longitudinal, generally horizontal jacket pathway with the open side of the jacket facing transversely to the direction of motion;

opening the jacket by raising the first leaf at the open side of the jacket;

directing said first leaf into a generally longitudinally extending first leaf pathway elevated above the jacket pathway and having pressurized air forming air cushions supporting the first leaf on opposite faces thereof;

directing said second leaf into a generally longitudinally extending second leaf pathway having pressurized air forming an air cushion suppressing the second leaf on one face thereof and having a support means opposed to the suppressing air cushion and substantially horizontally coplanar with the jacket pathway for supporting the second leaf on a second face thereof;

conveying an insert along an insert pathway intersecting said jacket pathway vertically between the first and second leaf pathways and at the open side of the jacket;

directing the insert into the open jacket between the first and second leaves thereof through a slot between the first and second leaf pathways; and closing the jacket.

14. The method of claim 13, further comprising providing pressurized air to form an air cushion on the top and bottom margins of said slot for vertically centering the insert in the slot.

* * * * *